US008028808B2

(12) United States Patent
Gonzalez Rodil et al.

(10) Patent No.: US 8,028,808 B2
(45) Date of Patent: Oct. 4, 2011

(54) RETRACTABLE STOP FOR MAINTAINING OVERHEAD CLEARANCE ABOVE AN ELEVATOR CAR

(75) Inventors: Jose Manuel Gonzalez Rodil, Madrid (ES); Francisco Manuel Cervera Morales, Madrid (ES); Jose Juan Caballero Garcia, Madrid (ES); Fernando del Rio Sanz, Madrid (ES); Antonio De Miguel Urquijo, Madrid (ES); Andres Monzon Simon, Madrid (ES)

(73) Assignee: Otis Elevator Company, Farmington, CT (US)

( * ) Notice: Subject to any disclaimer, the term of this patent is extended or adjusted under 35 U.S.C. 154(b) by 516 days.

(21) Appl. No.: 12/299,201

(22) PCT Filed: Jun. 26, 2006

(86) PCT No.: PCT/US2006/024983

§ 371 (c)(1),
(2), (4) Date: Oct. 31, 2008

(87) PCT Pub. No.: WO2008/002300

PCT Pub. Date: Jan. 3, 2008

(65) Prior Publication Data

US 2009/0183955 A1 Jul. 23, 2009

(51) Int. Cl.
*B66B 1/34* (2006.01)

(52) U.S. Cl. ..... 187/391; 187/306; 187/377

(58) Field of Classification Search ..... 187/391–393, 187/279, 282, 288, 294, 300, 302, 306–310, 187/314, 325, 331–333, 356, 357, 359, 360, 187/362, 414

See application file for complete search history.

(56) References Cited

U.S. PATENT DOCUMENTS 5,283,400 A * 2/1994 Leone et al. ..... 187/391
5,727,657 A * 3/1998 Foelix ..... 187/356

(Continued)

FOREIGN PATENT DOCUMENTS

CH 667638 A5 10/1988

(Continued)

OTHER PUBLICATIONS

International Preliminary Report on Patentability for International Application No. PCT/US2006/024983 mailed Oct. 7, 2008.

(Continued)

*Primary Examiner* — Anthony Salata
(74) *Attorney, Agent, or Firm* — Carlson, Gaskey & Olds PC

(57) ABSTRACT

An assembly (30) controls the amount of downward movement of a counterweight (24) within an elevator system (20). By limiting the downward movement of the counterweight (24), a desired overhead clearance above an elevator car (22) can be maintained. One example includes at least one safety device (80, 84, 86, 88) on top of the elevator car (22) to provide an indication for when a holding member (34) should allow a stop member of the assembly (30) to move into a position to limit the downward movement of the counterweight (24). In one example, the stop member (32) moves into an employed position by the force of gravity and is manually moveable back into a retracted position when it is not needed. One example includes a guide member (60) that facilitates controlling the position of the stop member (32) when it is in the employed position.

22 Claims, 2 Drawing Sheets

U.S. PATENT DOCUMENTS

| | | | | |
|---|---|---|---|---|
| 5,773,771 | A * | 6/1998 | Chatham | 187/282 |
| 6,202,797 | B1 * | 3/2001 | Skolnick et al. | 187/317 |
| 6,481,534 | B1 * | 11/2002 | Malone, Jr. | 187/377 |
| 6,550,585 | B2 * | 4/2003 | Schoppa et al. | 187/391 |
| 7,249,656 | B2 * | 7/2007 | Huber et al. | 187/343 |
| 7,281,609 | B2 * | 10/2007 | Del Rio Sanz et al. | 187/316 |
| 7,322,445 | B2 * | 1/2008 | Kocher et al. | 187/362 |
| 7,650,969 | B2 * | 1/2010 | Monzon et al. | 187/300 |

FOREIGN PATENT DOCUMENTS

| | | | |
|---|---|---|---|
| DE | 10052459 | | 5/2002 |
| EP | 1207129 | A2 | 5/2002 |
| EP | 1479636 | A1 | 11/2004 |
| WO | 2005026033 | A1 | 3/2005 |

OTHER PUBLICATIONS

International Search Report and Written Opinion of the International Searching Authority for International application No. PCT/US2006/024983 mailed May 3, 2007.

* cited by examiner

RETRACTABLE STOP FOR MAINTAINING OVERHEAD CLEARANCE ABOVE AN ELEVATOR CAR

FIELD OF THE INVENTION

This invention generally relates to elevator systems. More particularly, this invention relates to maintaining a safe overhead clearance above an elevator car during maintenance or inspection.

DESCRIPTION OF THE RELATED ART

Elevator systems include a variety of safety devices for different conditions. There are known devices for keeping maintenance personnel safe during inspection or maintenance procedures, for example. One type of such safety device is shown in the Swiss patent document 667,638 and includes a support in the pit of a hoistway that is moveable into a position to contact the bottom of an elevator car to prevent the car from entering the pit. Another device is shown in U.S. Pat. No. 5,727,657. That device has a similar function and a powered actuator for moving the blocking device.

Recent developments in elevator systems include eliminating a machine room above a hoistway and installing the elevator machine near the top of the hoistway. Such machine roomless elevator systems have lower clearance between the elevator car and the highest surface within the hoistway, for example. Other modern elevator systems have low overhead clearance during normal operation even if they are not of the machine roomless type. Those skilled in the art are always striving to improve safety arrangements that facilitate protecting personnel on top of the car during an inspection or maintenance procedure, for example.

SUMMARY OF THE INVENTION

An exemplary elevator assembly includes an elevator car and a counterweight coupled with the elevator car. At least one safety device is supported on top of the elevator car. A stop member automatically moves responsive to an indication from the safety device from a retracted position to an employed position where the stop member limits movement of the counterweight in a downward direction to thereby limit movement of the elevator car in an upward direction.

In one example, the indication from the safety device is one that an individual is on top of the elevator car.

In one example, the safety device is a balustrade that is moveable into an inspection mode position on top of the elevator car and the stop member in this example moves into the employed position responsive to the balustrade being in the inspection mode position.

In another example, at least one sensor detects the presence of an individual on top of the elevator car to provide the indication to the stop member to move into the employed position.

An exemplary assembly for limiting movement of an elevator counterweight includes a stop member pivotally supported near a first end of the stop member such that the stop member is moveable between a retracted position and an employed position. In the retracted position, a second, opposite end of the stop member is generally vertically aligned with the first end. In the employed position, the second end is vertically offset from the first end and the stop member is at an oblique angle relative to the retracted position. A guide member near the second end of the stop member has a first portion that is pivotally connected to the stop member. A second portion of the guide member has at least one arm for engaging a stationary vertical surface such that the guide member limits a distance that the second end of the stop member moves in a horizontal direction as the stop member moves from the retracted position to the employed position.

The various features and advantages of this invention will become apparent to those skilled in the art from the following detailed description. The drawings that accompany the detailed description can be briefly described as follows.

DETAILED DESCRIPTION

This invention facilitates maintaining a desired amount of overhead clearance above an elevator car within a hoistway. An assembly is situated for limiting movement of a counterweight in a downward direction. Preventing the counterweight from moving below a desired level ensures that the associated elevator car will not move above a selected height within the hoistway. In a disclosed example, at least one safety device on top of an elevator car provides an indication for when to move a stop member into a position to limit downward movement of the counterweight for providing the desired overhead clearance above the elevator car.

Figure 1:
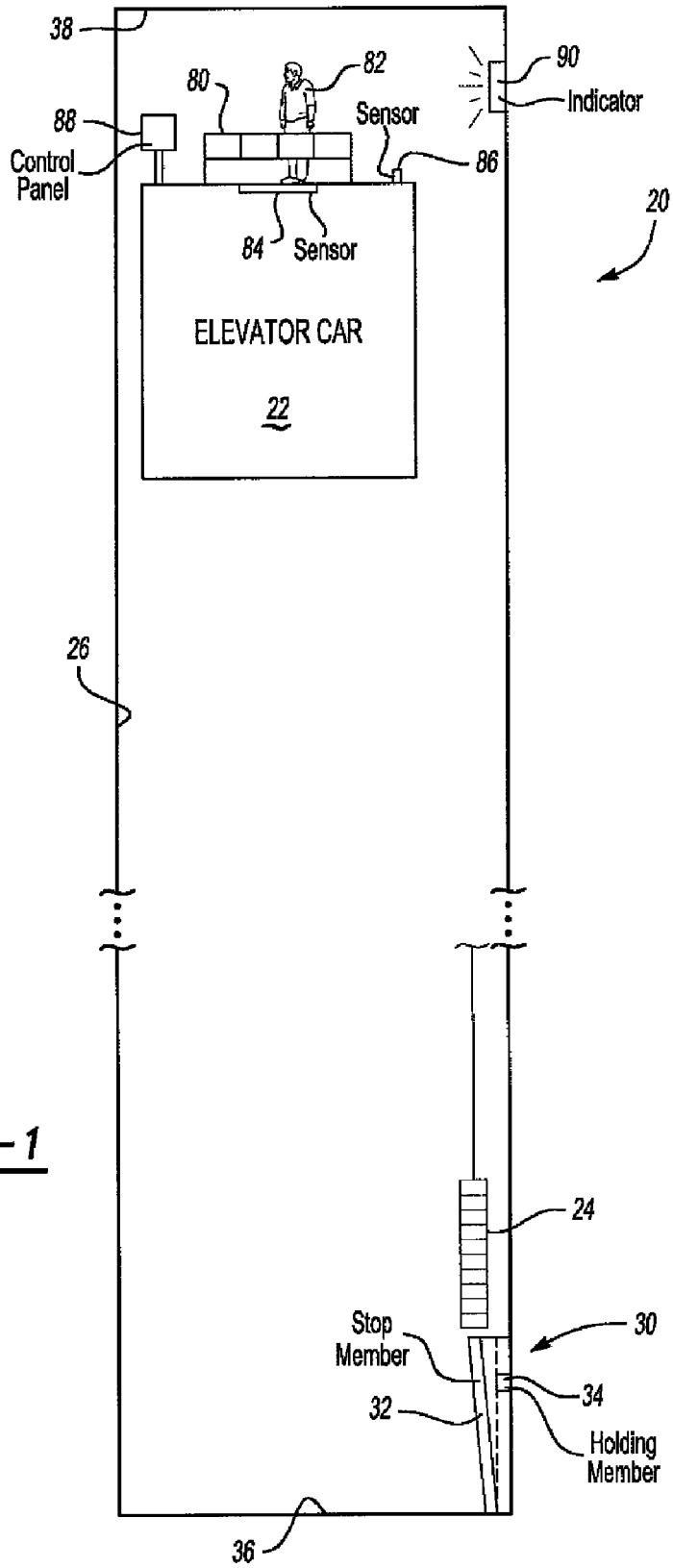
FIG. 1 schematically illustrates selected portions of an elevator system that is useful with an embodiment of this invention.

FIG. 1 schematically illustrates selected portions of an elevator system 20 that includes an elevator car 22 coupled with a counterweight 24 for vertical movement within a hoistway 26 in a generally known manner. For example, the counterweight 24 and elevator car 22 are coupled using roping or belts in a known configuration.

An assembly 30 includes a stop member 32 that is selectively positioned to limit the downward movement of the counterweight 24 within the hoistway 26. By preventing the counterweight 24 from dropping below a selected level, the elevator car 22 is prevented from rising above a selected height.

In the illustrated example, a holding member 34 maintains the stop member 32 in a retracted position for normal elevator system operation when the counterweight 24 is allowed to move very close to the bottom 36 of the hoistway 26 and the elevator car 22 is allowed to move very close to the top 38 of the hoistway 26.

There are times when an inspection or maintenance procedure will be required within the elevator system 20. During such times, it is desirable to maintain an adequate overhead clearance above the elevator car so that there is sufficient space between the top 38 of the hoistway 26 and the top of the elevator car 22 for a technician or maintenance personnel to have access to the top of the elevator car 22. For such situations, the holding member 34 releases the stop member 32 so that the stop member 32 can move into an employed position where it limits the downward movement of the counterweight 24. In the illustrated example, the stop member 32 is biased into the employed position by gravity and its own weight moves it into the employed position schematically shown in FIG. 1 from a retracted position schematically shown in phantom in FIG. 1. This example requires manually resetting the position of the stop member 32 into the retracted position where it can be maintained by the holding device 34 until the next time it is needed for maintaining adequate overhead clearance above the elevator car 22.

Figure 2:
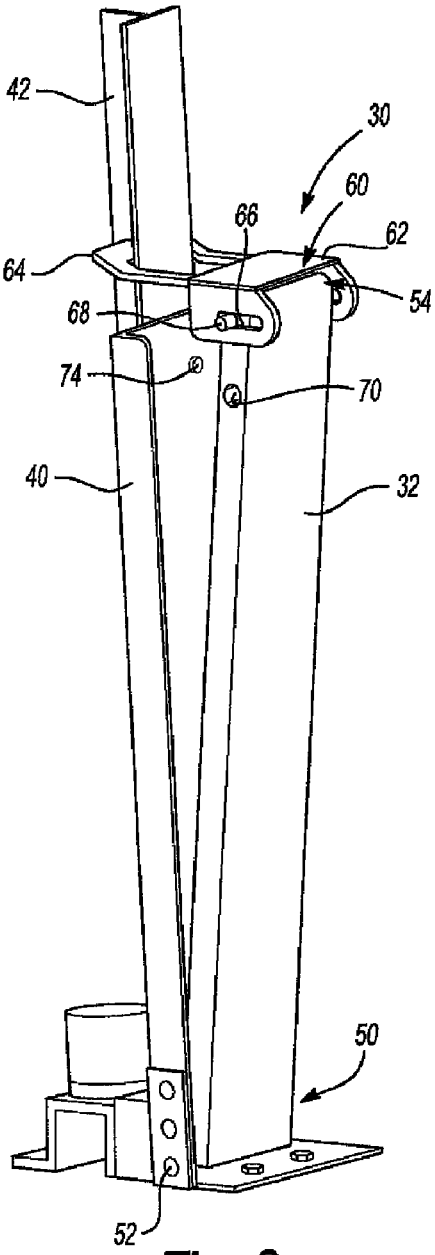
FIG. 2 is a perspective illustration of an example assembly for limiting movement of a counterweight in a downward direction.
Figure 3:
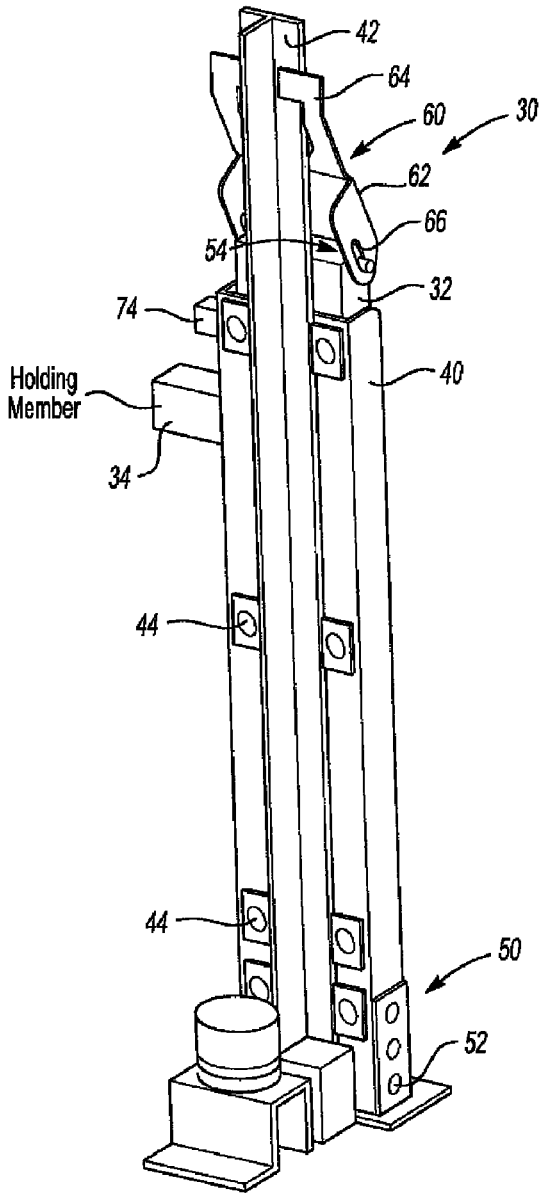
FIG. 3 is a perspective illustration of the embodiment of FIG. 2 from another view and in another position.

Referring to FIGS. 2 and 3, an example assembly 30 includes a mounting channel 40 that is secured to a stationary vertical surface. In this example, the mounting channel 40 is secured to a guide rail 42 by a plurality of fasteners 44. In this example, the guide rail 42 is useful for guiding vertical movement of at least one of the elevator car 22 or the counterweight 24 within the hoistway 26, for example. The mounting channel 40 is aligned parallel with the guide rail 42, which is secured in a stationary, vertical position within the hoistway 26 in a known manner.

The stop member 32 includes a first end 50 that is pivotally supported by the mounting channel 40 at a pivot connection 52. A second, opposite end 54 of the stop member 32 is vertically aligned with the first end 50 when the stop member 32 is in the retracted position shown in FIG. 3. The stop member 32 is held in the retracted position shown in FIG. 3 by the holding member 34.

When the holding member 34 releases the stop member 32, the second end 54 falls away from the mounting channel 40 into the employed position shown in FIG. 2. This example includes a guide member 60 that limits the amount of horizontal distance between the second end 54 of the stop member 32 and the mounting channel 40. Stated another way, the guide member 60 controls the oblique angle at which the stop member 32 is oriented relative to the mounting channel 40 when the stop member 32 is in the employed position where it will limit the downward vertical movement of the counterweight 24.

In this example, the guide member 60 has a first portion 62 that is pivotally mounted to the stop member 32 near the first end 54. In this example, the first portion 62 comprises a strike plate that covers over the second end 54 of the stop member 32 when the stop member 32 is in the employed position of FIG. 2. The strike plate of the first portion 62 makes physical contact with a corresponding portion of the elevator counterweight 24 if the counterweight 24 moves sufficiently low within the hoistway.

A second portion 64 of the guide member 60 in this example includes two arms that engage a fixed vertical surface such as a surface on the guide rail 42. The arms in this example are generally L-shaped projections extending from the strike plate of the first portion 62 of the guide member 60. As can be appreciated from the drawings, as the stop member 32 moves from the retracted position of FIG. 3 into the employed position of FIG. 2, the arms of the second portion 64 slide along the guide rail 42 and the first portion 62 pivots relative to the second end 54 of the stop member 32. In this example, the first portion 62 includes a slot 66 that follows a pin or protrusion 68 on the stop member 32 near the second end 54. The guide member 60 provides a stable and reliable control of the position of the stop member 32 relative to the mounting channel 40 and guide rail 42. In one example, the stop member 32, mounting channel 40 and guide member 60 all comprise metal components.

Figure 4:
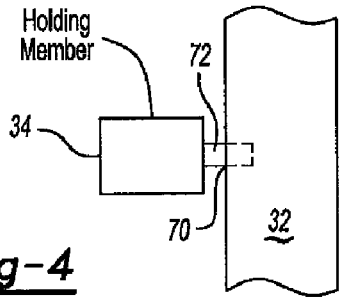
FIG. 4 schematically illustrates a selected feature of the embodiment of FIGS. 2 and 3.

As schematically shown in FIG. 4, the holding member 34 includes a pin 72 that protrudes into at least one opening 70 in a side of the example stop member 32. The pin 72 moves in a direction that is generally perpendicular to the direction of movement of the stop member 32 between the retracted position and the employed position. The holding member 34 includes an electrically powered actuator such as a solenoid coil that controls position of the pin 72. In one example, the pin 72 is moved by the actuator portion of the holding member 34 so that the pin 72 is retracted away from the stop member 32 whenever it is desirable for the stop member 32 to move into the employed position.

The illustrated example includes at least one switch 74 for providing an indication of the current position of the stop member 32. The switch 72 may provide an indication of when the stop member 32 is in the retracted position, in the employed position or both.

In one example, the holding member 34 is controlled responsive to an indication from at least one safety device on top of the elevator car 22. Referring to FIG. 1, the illustrated example includes a balustrade or barricade 80 that can selectively be placed in position on top of the elevator car 22 by an individual 82. Whenever the balustrade 80 is in an inspection mode position (e.g., where it provides a safety barrier function), a switch or sensor that detects that position provides an indication to the holding member 34 to retract the pin 72 to allow the stop member 32 to move into the employed position. Other safety devices may be used for the same purpose alone or in combination with one or more safety devices.

The illustrated example includes at least one sensor 84 for detecting the weight of the individual 82 on top of the elevator car 22. Another sensor 86 uses known technology such as a motion detector or a light line sensor for detecting the presence of the individual 82 on top of the elevator car 22.

Another example safety device shown in FIG. 1 is a control panel 88 on top of the elevator car 22 that includes at least one switch that can be manipulated by an authorized individual 82 for a desired function when the elevator system 20 is in an inspection mode. Activation of such a switch in one example provides the indication to the holding member 34 to allow the stop member 32 to move into the employed position.

In one example, the control panel 88 also includes an indicator for providing at least one of a visible (e.g., light) or audible indication of the position of the stop member 32 that is discernable from the top of the elevator car 22. In one example, whenever the stop member 32 moves into the employed position, a corresponding visible or audible indication is provided on top of the elevator car 22 to provide assurance to the individual 82 regarding the function of the stop member 32 for maintaining adequate overhead clearance above the elevator car 22.

The illustrated example includes another indicator 90 supported within the hoistway 26 in a position where it can be observed (e.g., heard or seen) by the individual 82 on top of the elevator car 22. An indicator on the control panel 88, the indicator 90 or a combination of them may be used to meet the needs of a particular situation.

Given this description, those skilled in the art will realize what combination of safety devices on top of the elevator car 22, indicators or both will be sufficient to meet the needs of their particular situation. For example, those skilled in the art will be able to select from among known components and to arrange wire line-based or wireless communications between such devices to achieve the desired control of the position of the stop member 32 and the desired indications provided near the top of the elevator car 22.

The disclosed example includes an automated release of the stop member 32 into an employed position. The illustrated example is manually moved back into a retracted position after the overhead clearance provided by the stop member 32 is no longer needed. Once in the retracted position, the holding member 34 then maintains the stop member in that position until the next time it is needed to provide overhead clearance above the elevator car 22. In one example, the holding member 34 responds to the stop member 32 moving into the retracted position by allowing the pin 72 to extend from the actuator so that the pin 72 is received in the opening 70, for example. In another example, a separate switch that is manually controllable is used to release the pin 72 into a holding position.

The disclosed example provides an improved way of ensuring adequate overhead clearance above an elevator car 22 in a so-called low overhead elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator assembly, comprising an elevator car;

a counterweight coupled with the elevator car;

at least one safety device supported on a top of the elevator car; and a stop member that is configured to automatically move responsive to an indication from the at least one safety device from a retracted position to an employed position where the stop member is configured to limit movement of the counterweight in a downward direction to thereby limit movement of the elevator car in an upward direction; and, at least one of a visible or audible indicator that is perceivable from the top of the elevator car, the at least one indicator being configured to provide a corresponding indication when the stop member is in the employed position.

2. The assembly of claim 1, wherein the indication is one that an individual is on top of the elevator car or one that an individual is attempting to access the top of the elevator car.

3. The assembly of claim 1, wherein the safety device comprises a balustrade that is moveable into an inspection mode position on the top of the elevator car and wherein the stop member will move into the employed position responsive to the balustrade being in the inspection mode position.

4. The assembly of claim 1, wherein the safety device comprises at least one sensor for detecting a presence of an individual on the top of the elevator car.

5. The assembly of claim 1, wherein the at least one of the visible or audible indicator is configured to provide a corresponding indication when the stop member is in the retracted position.

6. The assembly of claim 1, wherein the stop member is pivotally supported near a first end of the stop member such that the stop member is pivotally moveable between the retracted position where a second, opposite end of the stop member is generally vertically aligned with the first end and the employed position where the second end is vertically offset from the first end and the stop member is at an oblique angle relative to the retracted position.

7. An elevator assembly, comprising an elevator car:

a counterweight coupled with the elevator car;

at least one safety device supported on a top of the elevator car; and a stop member that is configured to automatically move responsive to an indication from the at least one safety device from a retracted position to an employed position where the stop member is configured to limit movement of the counterweight in a downward direction to thereby limit movement of the elevator car in an upward direction, wherein the stop member is pivotally supported near a first end of the stop member such that the stop member is pivotally moveable between the retracted position where a second, opposite end of the stop member is generally vertically aligned with the first end and the employed position where the second end is vertically offset from the first end and the stop member is at an oblique angle relative to the retracted position;

at least one fixed vertical member;

a guide member near the second end of the stop member, the guide member having a first portion that is pivotally connected to the stop member and a second portion having at least one arm for engaging a surface on the fixed vertical member such that the guide member limits a distance between the surface and the second end of the stop member when the stop member is in the employed position;

at least one of a visible or audible indicator that is perceivable from the top of the elevator car, the at least one indicator being configured to provide a corresponding indication when the stop member is in the employed position.

8. The assembly of claim 7, wherein the at least one arm is configured to move vertically and to follow the surface as the stop member moves between the retracted and employed positions and the first portion simultaneously pivots relative to the stop member.

9. The assembly of claim 7, wherein the guide member second portion comprises two arms that each engage a surface on the fixed vertical member, each of the two arms having an end facing opposite and spaced from the other such that a portion of the fixed vertical member is received between the ends of the two arms.

10. An elevator assembly, comprising an elevator car;

a counterweight coupled with the elevator car;

at least one safety device supported on a top of the elevator car; and a stop member that is configured to automatically move responsive to an indication from the at least one safety device from a retracted position to an employed position where the stop member is configured to limit movement of the counterweight in a downward direction to thereby limit movement of the elevator car in an upward direction;

an electrically activated holding member that comprises a pin that is moveable horizontally relative to the stop member between a holding position where the pin engages the stop member for holding the stop member in the retracted position and a release position where the pin does not interfere with movement of the stop member and wherein the stop member is biased to move from the retracted position to the employed position whenever the pin is in the release position;

an electrically powered actuator that is operative to selectively move the pin into at least the release position; and at least one of a visible or audible indicator that is perceivable from the top of the elevator car, the at least one indicator being configured to provide a corresponding indication when the stop member is in the employed position.

11. The assembly of claim 10, wherein the pin is at least partially received into a hole in the stop member when the pin is in the holding position.

12. The assembly of claim 1, comprising at least one signaling device that provides a signal for indicating when the stop member is in at least the employed position.

13. An assembly for limiting movement of an elevator counterweight, comprising a stop member pivotally supported near a first end of the stop member such that the stop member is moveable between a retracted position where a second, opposite end of the stop member is generally vertically aligned with the first end and an employed position where the second end is vertically offset from the first end and the stop member is at an oblique angle relative to the retracted position; and a guide member near the second end of the stop member, the guide member having a first portion that is pivotally connected to the stop member and a second portion having at least one arm for engaging a stationary vertical surface such that the guide member limits a distance that the second end of the stop member moves in a horizontal direction as the stop member moves from the retracted position to the employed position, the guide member comprises a strikeplate that at least partially covers the second end of the stop member when the stop member is in the employed position, the strikeplate being configured to make physical contact with a corresponding portion of the elevator counterweight.

14. The assembly of claim 13, comprising a counterweight that is supported for vertical movement relative to the stop member and wherein the counterweight contacts the strikeplate of the guide member if the counterweight is in a corresponding vertical position when the stop member is in the employed position.

15. The assembly of claim 13, comprising at least one fixed vertical member and wherein the at least one arm engages a surface on the fixed vertical member when the stop member is in the employed position.

16. The assembly of claim 15, wherein the at least one arm is configured to move vertically and to follow the surface as the stop member moves between the retracted and employed positions and the first portion simultaneously pivots relative to the stop member.

17. The assembly of claim 15, wherein the guide member second portion comprises two arms that each engage a surface on the fixed vertical member, each of the two arms having an end facing opposite and spaced from the other such that a portion of the fixed vertical member is received between the ends of the two arms.

18. The assembly of claim 13, comprising a holding member having a pin that is moveable horizontally relative to the stop member between a holding position where the pin engages the stop member for holding the stop member in the retracted position and a release position where the pin does not interfere with movement of the stop member and wherein the stop member is biased to move from the retracted position to the employed position whenever the pin is in the release position.

19. The assembly of claim 18, wherein the stop member is manually moveable from the employed position to the retracted position.

20. The assembly of claim 13, comprising at least one signaling device that comprises at least one switch for detecting when the stop member is in the employed position; and at least one of a visual or audible indicator that is configured to provide an indication of the employed position of the stop member responsive to the at least one switch.

21. An assembly for limiting movement of an elevator counterweight, comprising a stop member pivotally supported near a first end of the stop member such that the stop member is moveable between a retracted position where a second, opposite end of the stop member is generally vertically aligned with the first end and an employed position where the second end is vertically offset from the first end and the stop member is at an oblique angle relative to the retracted position;

a guide member near the second end of the stop member, the guide member having a first portion that is pivotally connected to the stop member and a second portion having at least one arm for engaging a stationary vertical surface such that the guide member limits a distance that the second end of the stop member moves in a horizontal direction as the stop member moves from the retracted position to the employed position; and at least one fixed vertical member and wherein the at least one arm engages a surface on the fixed vertical member when the stop member is in the employed position, wherein the at least one arm is configured to move vertically and to follow the surface as the stop member moves between the retracted and employed positions and the first portion simultaneously pivots relative to the stop member.

22. The assembly of claim 21, wherein the guide member second portion comprises two arms that each engage a surface on the fixed vertical member, each of the two arms having an end facing opposite and spaced from the other such that a portion of the fixed vertical member is received between the ends of the two arms.

* * * * *